US006629014B1

(12) United States Patent
Lam

(10) Patent No.: US 6,629,014 B1
(45) Date of Patent: Sep. 30, 2003

(54) PERSONALIZED GARMENT COORDINATION APPARATUS

(76) Inventor: Peter Ar-Fu Lam, 20104 Wayne Ave., Torrance, CA (US) 90503

( * ) Notice: Subject to any disclaimer, the term of this patent is extended or adjusted under 35 U.S.C. 154(b) by 0 days.

(21) Appl. No.: 09/685,311

(22) Filed: Oct. 10, 2000

Related U.S. Application Data

(62) Division of application No. 09/374,657, filed on Aug. 16, 1999, now Pat. No. 6,182,871.

(51) Int. Cl.[7] ..... G06F 19/00; A41D 27/22

(52) U.S. Cl. ..... 700/130; 223/92; 382/111; 434/307 R

(58) Field of Search ..... 700/130, 139, 700/143, 132; 356/394; 382/111; 348/77; 345/435; 223/85, 92, 68; 434/307 R; 211/103, 119, 168

(56) References Cited

U.S. PATENT DOCUMENTS 2,665,040 A * 1/1954 Reid ..... 223/68
2,690,844 A * 10/1954 Torrance ..... 211/119
3,058,599 A * 10/1962 Brylski ..... 211/168
3,102,639 A * 9/1963 Hightower ..... 211/103
4,486,774 A * 12/1984 Maloomian ..... 348/77
4,539,585 A * 9/1985 Spackova et al. ..... 382/100
4,739,911 A * 4/1988 Quinn ..... 223/85
5,163,007 A * 11/1992 Slilaty ..... 700/132
5,441,414 A * 8/1995 Chretien ..... 434/307 A
5,530,652 A * 6/1996 Croyle et al. ..... 382/111 X
5,553,277 A * 9/1996 Hirano et al. ..... 707/104.1
5,937,081 A * 8/1999 O'Brill et al. ..... 382/111
5,937,232 A * 8/1999 Taguchi et al. ..... 399/81
6,012,619 A * 1/2000 Lam ..... 223/85 X

* cited by examiner

*Primary Examiner*—Peter Nerbun

(57) ABSTRACT

An apparatus especially configured for users to easily coordinate or harmonize apparel before putting the clothing on. The embodiments include a frame member defining a display region configured for displaying the personalized real human facial image of a user. In a first embodiment, the display region is positioned on top of a garment supporting device. In a second embodiment, the display region comprises a computer monitor. In a third embodiment, the facial or garment image is retrieved from a remote computer.

21 Claims, 4 Drawing Sheets

PERSONALIZED GARMENT COORDINATION APPARATUS

RELATED APPLICATIONS

This application is a divisional application of U.S. patent application Ser. No. 09/374,657 issued Aug. 16, 1999, U.S. Pat. No. 6,182,871 which is by reference incorporated herein.

This application is to further precisely defining the variation and enhancement of U.S. patent application Ser. No. 09/374,657 filed Aug. 16, 1999.

BACKGROUND OF THE INVENTION

This invention relates generally to apparatus for facilitating a user to select, coordinate, appraise and harmonize garment clothing without actually putting on the garment.

The prior art reveals many garment hangers having a facial drawing combined with a garment hanger for store display purposes. For example only, attention is directed to the following U.S. Patents:

U.S. Pat. Nos. Des. 253,447 1,096,018 3,126,237 4,739, 911.

SUMMARY OF THE INVENTION

The present invention is firstly directed to an apparatus disclosed in applicant's U.S. patent application Ser. No. 09/374,657, pending issue. This apparatus comprises a photograph representing the life-size visual representation of a particular user's face. Such apparatus can be especially featured to provide an unusual application so as to assist the user in selecting clothing articles which coordinate to form an attractive outfit for that user. An enhancement of this embodiment is to arrange a set up for an apparel retail shop to instantly capture the life size facial image of a preferred customer and print it on the medial portion of a garment hanger. The customer then make use of this special apparatus to support and coordinate their selected apparel and has a quick appraisal of the harmony effect with his/her face on it without actually putting on the apparel.

In accordance of another preferred embodiment, the frame member is configured in the form of a stand. An electronics display apparatus such as a computer monitor is provided at the top of the stand to display a personalized facial image. Receiver means such as hooks or receiver slots are provided behind the display region to receive the suspension hook of a garment hanger. For a user to coordinate or appraise the look of a particular garment, the garment supported on a regular hanger is supported by one of the receiver means such that the garment appears to be dressed by the user. The receiver means can be configured to enable vertical position adjustment so that the relative position of the garment from the facial image of the user can be adjusted to a proper location. A simple way to enable vertical adjustment is to offer more than one receiver hooks, one on top of another. In order to provide a personalized facial image for a customer, the fashion store is equipped with an apparatus to capture the facial image of a customer. Electronics cameras and scanners are representative apparatus used to convert the facial image of a customer into electronics data suitable to be displayed on the computer monitor on top of the stand, for displaying the facial image. A code word can be assigned to distinguish the digital image of one customer from another. This personalized coordination apparatus is not only an invaluable hospitality facility for the customers visiting the store, it offers the function to encourage customer to purchase the garment displayed under the computer monitor. The set up increase the efficiency for customers to check the matching of apparel and encourage them to try more different designs without actually putting the apparel on. As a result a store with limited space can handle a greater customer flow because the time spent by a customer to complete the transaction is reduced. The number of changing rooms required the customer's shopping requirements is also reduced. The room efficiency is particular important for stores having a limited floor space. Another advantage is that some garment of special nature such as T-shirt of delicate material is not recommended to be tested as they tend to be deformed by customers.

The term personalize is important to distinguish the invention with the prior art having simply a hanger and a facial drawing displayed at the medial portion of the hanger, such as Tully, U.S. Des. Pat. No. 253,447. A personalized coordination apparatus is a process with which a consumer has the right of choice which real person face image to be put onto the display region. In most situations the facial image selected belongs to the consumer, their relatives, friends or other specifically selected person. The personalized process is defined by any of the following characteristics when compared with a commercial display hanger having a facial drawing. Firstly, the coordination apparatus displays a facial image of a "user", instead of a non-removable beautifully designed facial image of a model. Secondly, the facial image of "any" user can be displayed on the computer monitor. The image of choice is therefore an important characteristic of the subject invention. Consumers have a desire to try the coordination apparatus because they have the control to select the facial image of choice. Commercial displaying hanger having a fixed facial image of a model does not provide choice of facial image for the consumer.

Another characteristic of the invention is that a proper coding system about the facial image is required by the subject invention to distinguish one face from another. When the invented apparatus is not being used by a customer, the system may pick up a default facial images of one or more models, possibly of different ethnic, different facial expressions, hair characteristics or different ages. These facial images may be displayed in sequence to attract different kinds of visiting customers In order to provide a friendly personalized service for different people, an efficient photo imaging process is provided at a point of sale. Cameras, scanners, picture editing facilities such as chroma-key equipment, and special photo treating software are also recommended.

In a different embodiment, a thin profile LCD monitor is particularly suitable for this application. In another preferred embodiment, garment-supporting frame in the shape of a human torso is positioned just below the computer monitor to provide the same function of the stand. It should be noted that sometimes a partial torso is adequate to provide the effect for the display apparatus invented. In yet another preferred embodiment, receiver means is provided behind the computer monitor to receive the hook of a garment hanger which supports the garment to be viewed. A preferred process to make use of this facility is as follow:

(1) Provide a facial image capture set up at a point of sale.

(2) Facial image of customers are collected with this setup.

(3) A facial image captured is digitized into electronics data represented by numbers of 1 and 0; and stored in a file.

(4) A code word or file name is assigned to each file to identify the facial image of one customer from another.

(5) The file is decoded and displayed on the computer monitor mounted on top of the garment displaying stand.

(6) Input device such as key pad, joystick, mouse, any other pointing device or voice recognition device are equipped to identify the facial image to be displayed and also to provide adjustment, options selection and modification of the facial image or the relative position of the image to be displayed.

Various facial image modification software are available in the market to change the color balance, provide visual effect and touch up deficiencies in the image capture or photo taking process. With more investment, multiple facial images of the customer different viewing angles can be collected. In this situation, the display stand requires rotation means for the viewing garment to be rotated when the orientation of the facial image is changed. If multiple facial images are collected at a high frame rate such as 25 frames per second while the viewing angle is continuously changing, the playback of the facial image at the monitor will provide a movie like movement result. To fully match with the movie play back effect, such as a head is turning left or right, the garment displaying mechanism is required to be moved in the same direction and in synchronization with the head turning motion displayed. The overall result becomes an animated presentation of the garment coordination and matching with the user.

Once a customer registered his/her facial image at a face image capturing facility, the selected image file identified by a code word can be sent to a remote computer by a communication channel. A network or communication channel refer to any means connecting two computing devices together, including but not limited to internet, intranet, extranet, ISDN, DSL and LAN. The communication channel can be provided by wired lines such as cable, optical lines or telephone lines. It can be connected to the computer by any commercially format of communication such as COM port, parallel port, USB port or any later developed technology to handle data transfer. The communication channel can be furnished by wireless channel such as RF and infra red channels as well. This user friendly service gives customers greater confidence before they decide a purchase and therefore avoids returns.

An enhancement of the system is to provide a local or centralized computer system storing the facial images of different customers. The data representing the facial image of a customer is sent to the display monitor of any similar set up in the store, in response to a request made by a customer. A customer may submit a request by keying his/her code word at a particular display station, or by submitting a tag containing the code. Typical examples of the personalized tag is a card containing optical sensitive data, magnetic encoded data or RF identification circuitry.

Another decentralized system of the invention is to store the facial image of a user in a miniature portable memory media such as magnetic floppy diskette, CD ROM or CD RAN. This portable media is kept by the user, their relatives or friends who want to purchase garment for the user. In this system, every display station should provide a facility to read the facial image data from the memory media.

The novel features of the invention are set forth with particularity in the appended claims. The invention will best be understood from the following description, when read in conjunction with the accompanying drawings.

DETAILED DESCRIPTION

Figure 1:
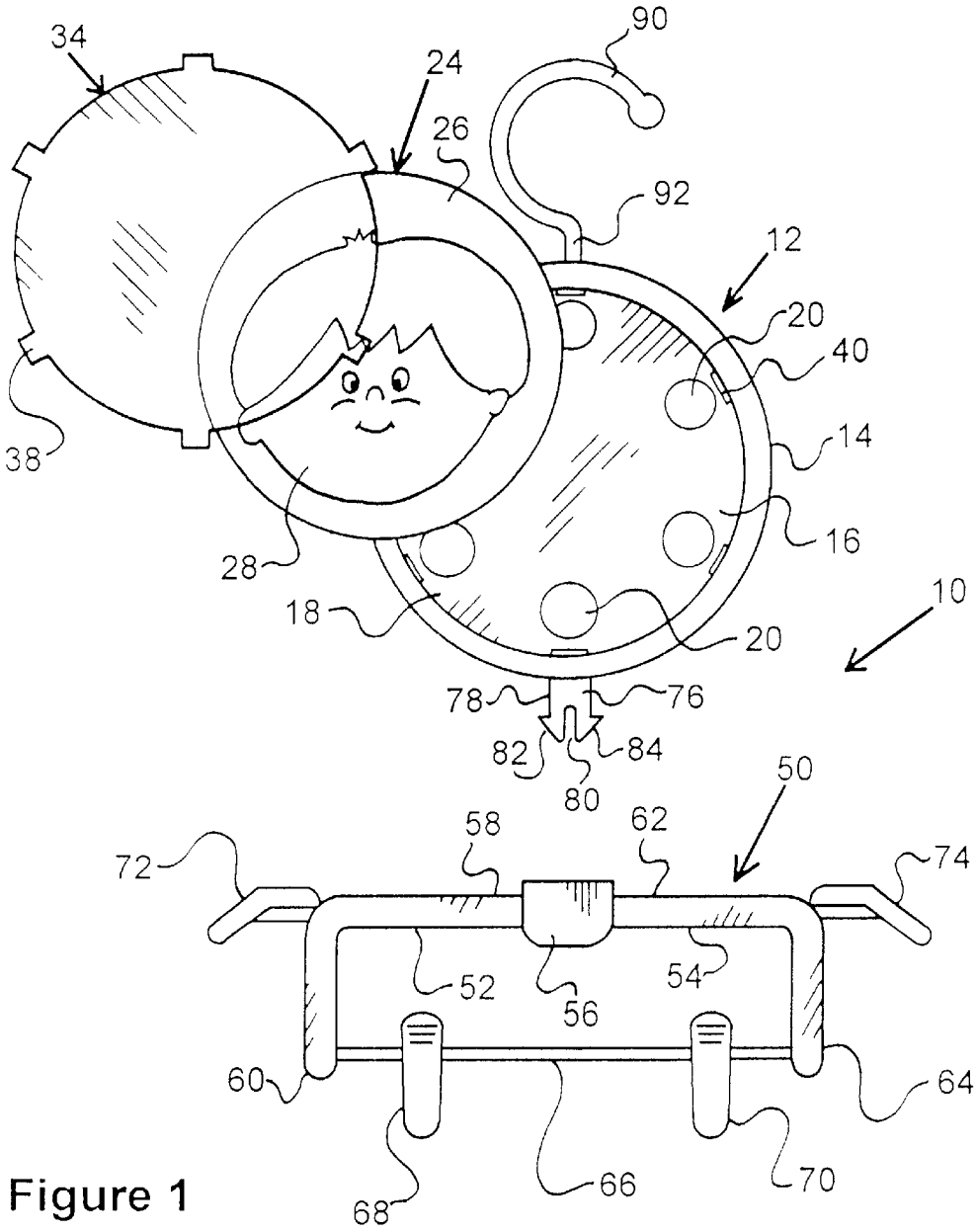
FIG. 1 is an exploded view of an embodiment of applicant's previously invented handicraft display apparatus.

Attention is initially directed to FIG. 1 which depicts an exploded view of an embodiment 10 in accordance with the invention particularly configured to encourage a child to create and display a handicraft while also encouraging that child to properly care for his/her articles of clothing. The apparatus 10 is comprised of a frame member 12 having a display area 16. A suspension or hook member 90 extends radially outward from the frame member 12 for vertically suspending the structural member from a horizontally oriented supporting surface (not shown) such as a wall mounted hook, a door top, or a horizontal rod. The handicraft 24 displayed may represent any art created by the child or the facial image of a character. The frame member 12 is provided with a mounting member 76 for attaching the frame member to the device 50.

Figure 2A:
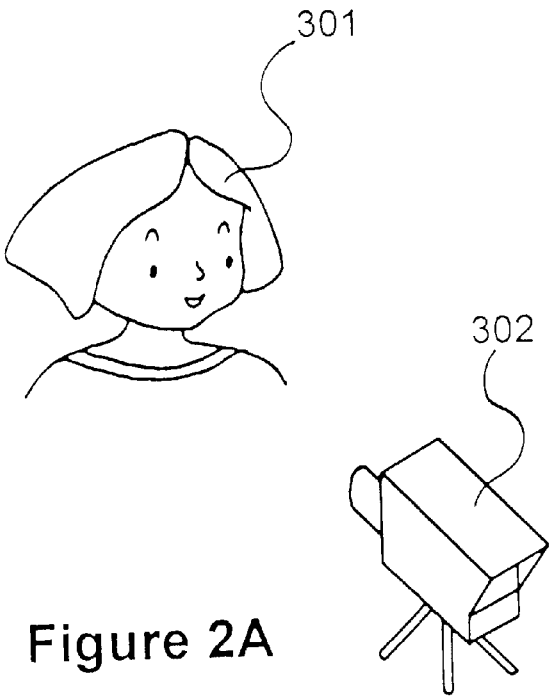
FIG. 2A illustrates a set up to capture the visual representation of a real human face.
Figure 2B:
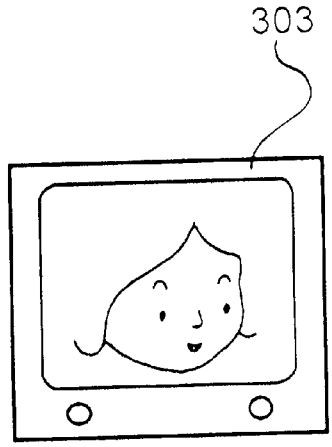
FIG. 2B illustrates the captured human face image to be displayed onto an electronics display device for monitoring, editing or modification purpose.

Attention is now directed to FIG. 2A and FIG. 2B which comprises a video camera 302 (FIG. 2A) to image the face of a user 301 with the output from a video camera being first presented on a display monitor 303 (FIG. 2B). The capture image of the face is then converted or digitized into digital data stored in memory or electronic data storage means such as disk drive, tape or solid state memory. Utilizing editing techniques, an operator can manipulate the image as desired before storing the data into the memory. Typical editing or modification features may include the manipulation of colors, shapes, sizes, positions of the object (the human face) and the addition of computer generated visual effects. Note in FIG. 3 that exemplary upper and lower garments are suspended from the invented apparatus. In order to support the lower garment such as trousers and skirts in appropriate position of the display set up, a suitable lower garment supporting means such as traditional skirt hanger is to be included into the display apparatus positioned in a suitable position beneath the upper garment supporting portion.

The apparatus having the facial image of a person is not only useful to the person himself; it can also be used by people to simulate the presence of their friends or relatives. For example, the apparatus may be used as a clothing gift selection tool by people to select appropriate for their friends or relatives without the actual presence of the person in the retail store.

Figure 3:
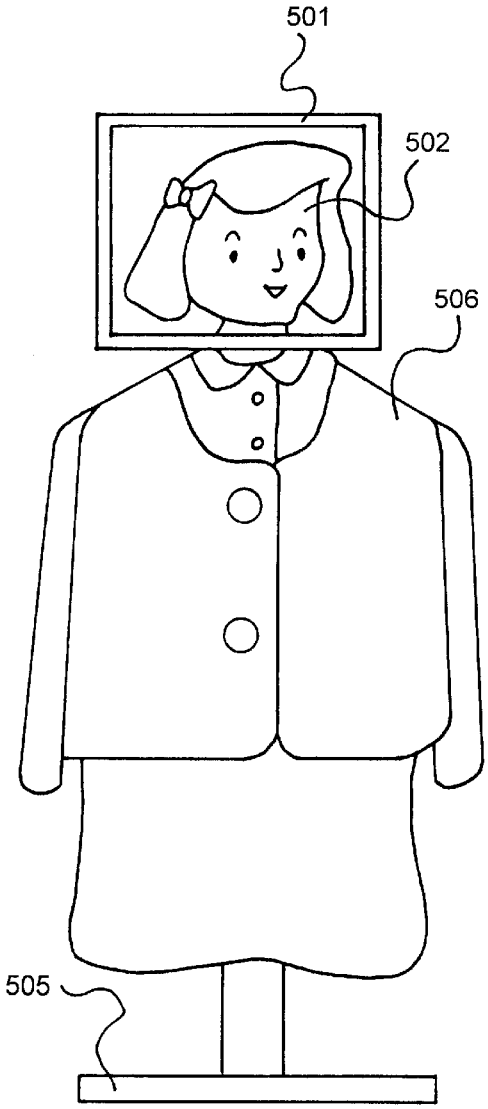
FIG. 3 is a front view of a floor stand having an electronics display device.

Accordingly, by providing the apparatus depicted in FIG. 3, modified by a visual representation of a user's face applied to the structural member 505, display region 502, a user is able to appraise the visual appearance of an outfit, i.e., collection of clothing articles and accessories, according to the matching effect with the actual facial image displayed.

It should be noted that the concept of the invention can be easily extended for a user to try wearing a hat. When the top portion of the facial image is modified to provide appropriate supporting frame behind the facial image, a hat can be supported. With this modification, the personalized facial image of FIG. 2B or 3 can be used to appraise or select a hat, a cap or other kinds of head decorations. For that reason, the term garment, apparel or clothing as defined in this application should therefore include hats and head decorative items to be wear by the user.

Figure 4:
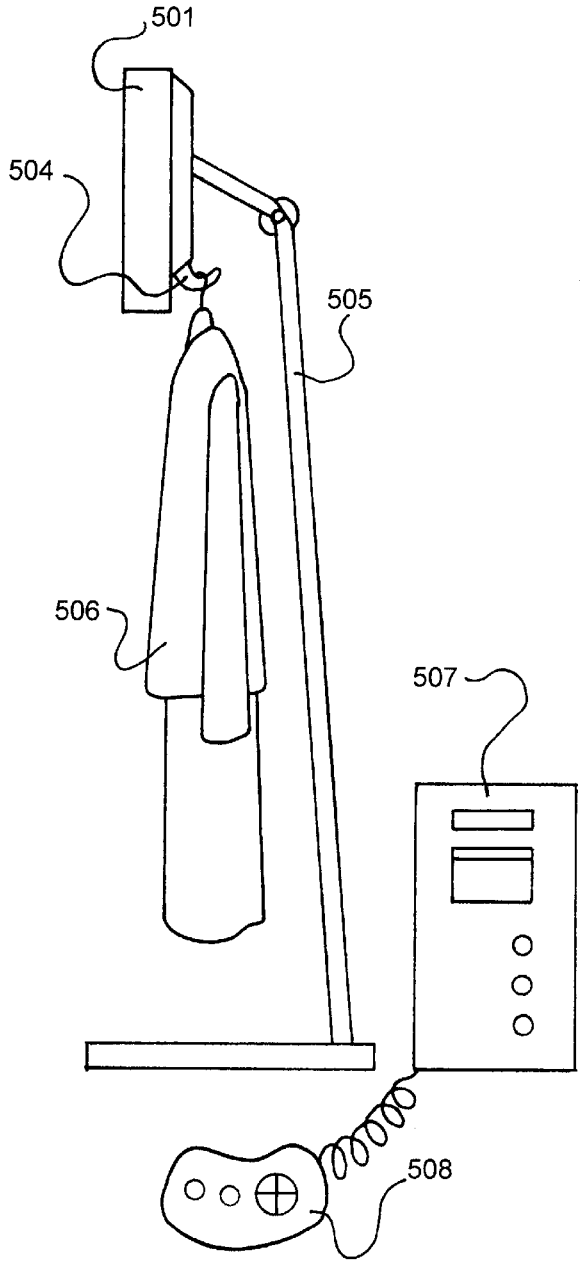
FIG. 4 is a side view of FIG. 4 together with a computer and controller.

FIG. 3 illustrates an alternative preferred embodiment having the display member 501 supported by a floor stand 505. The facial image 502 of an user is displayed on the screen. FIG. 4 is the side view of the set up shown in FIG. 3. The receiver 504 located behind the display region receives the hook member of a garment hanger supporting a garment 506. LCD monitor is preferred due to the preferable thin profile of the display member and the light weight it carries. To provide a quick coordination and harmony effect to many different customers, the display region can be in the form of a mirror. This embodiment will naturally present the particularly personalized facial image matched with a garment displayed when a customer stops by. In order to better fit the different heights of people and provide a proper effect, the mirror display region needs to be articulated or vertically adjusted with any known adjustment design capable to provide the desirable adjustment effect.

The computing device 507 converts the digital facial imager of a person and display it onto the screen of the electronics display device 501. The computing device 507 may receive the image data from a remote computer storing a library of facial images. A controller or input device 508 enables users to key in their own code word and fetch their own personalized facial images to be displayed onto the display screen. The input device can also be used to modify the presentation of the facial image such as modifying the color balance and adjusting the relative position of the image.

Figure 5:
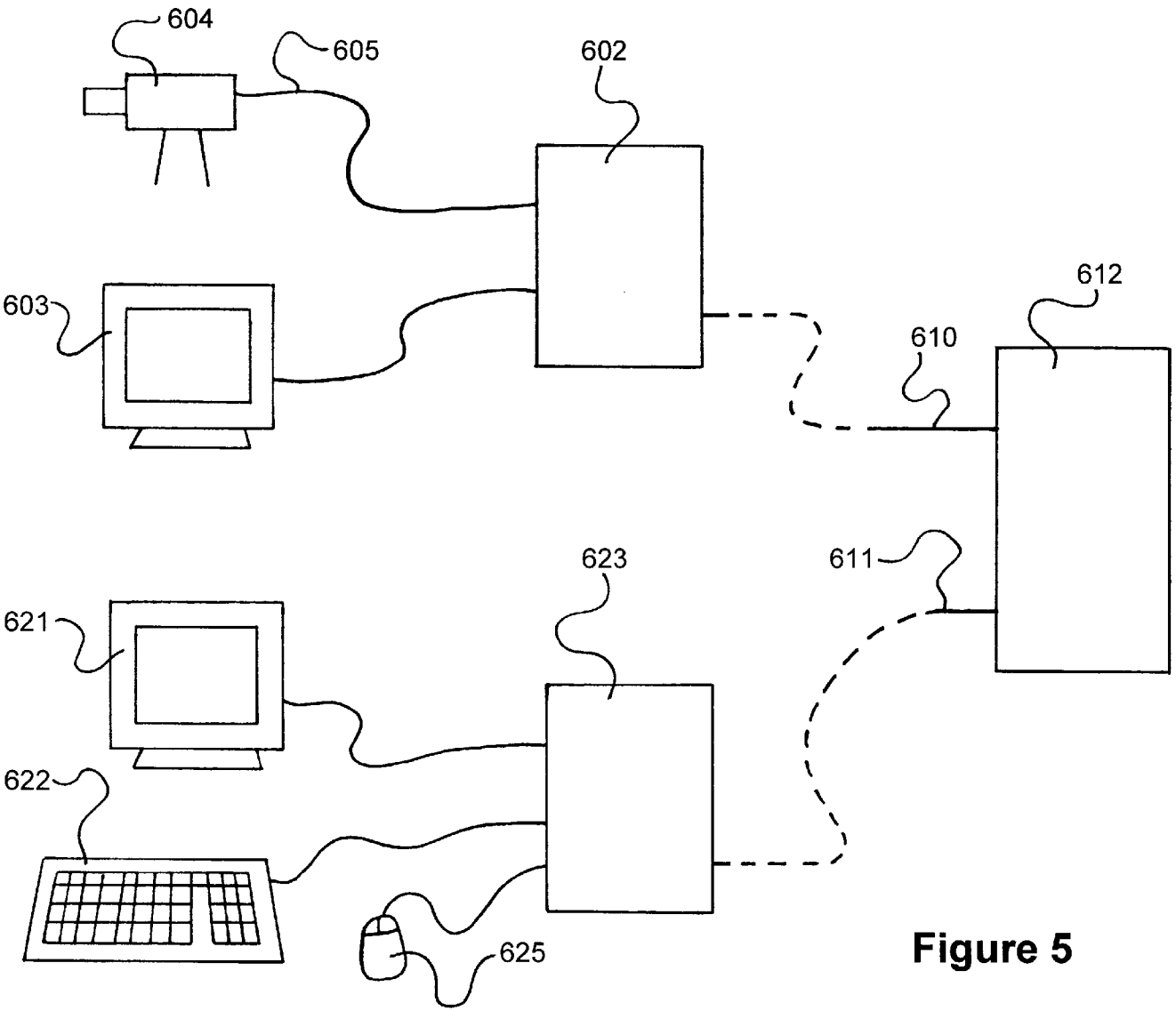
FIG. 5 shows a remote computer linked with a image capturing kiosk located at a point of sale and also a displaying computer connected through communication channels.

FIG. 5 shows a preferred system embodiment to use the information aspect of the invention. Video capturing device 604 in conjunction with computing device 602 captured the facial image of a person, converts the image into electronics data, usually represents by the digital numbers one and zero. The electronics image data stored in computer 602 is then transmitted to a remote computing device 612 through a communication channel 610. The image capture system and the data converting system is preferred to locate at a point of sale. A home computer in conjunction with a digital camera or a scanner may also be configured to perform the facial image capture function. A code comprising of one or more code words representing the person is assigned to identify the electronics image file captured.

Computer 623 is also configured to connect with the remote computer 612 through a communication channel 611. Monitor 621 displays a selected facial image to match with a selected garment displayed. Codes representing the selected facial image are entered into the computer 623 by any input or pointing devices such as the keyboard 622 or the mouse 626. Alternatively, users may coordinate and harmonize garment with the facial image of a friend or relative in order to select a garment gift for the particular friend and relative, without the real person to present on spot to support the selection and coordination process.

In one mode of operation, the camera and computer is set up at a point of sale and the customer takes a facial image at this spot. The customer may use the monitor 603 connected with the same computer 602, or the monitor 621, connected to the computer 623 to coordinate any facial image stored in any of the computers 602, 612 and 623 and match it with different garment displayed in the store.

In another mode of operation, the monitor 621 represents the facial displaying monitor 501 of FIG. 3. In this case, the regional computer 507 is identical to the computer 623. When the customer feels interest about the garment 506, he/she just key in the code that represents his/her facial image. The image will be shown on the monitor and the customer is ready to appraise how he/she will look with the garment 506 without actually putting the garment on.

It should be noted that the communication channels 610 and 611 can be any type of channels connecting two computers together, as defined in this specification, or any other way to connect between two computers not mentioned in the specification. It should be noted that the image capturing computer 602 and the image reading computer 623 may in fact be the same single computer to carry out the preferred function of the subject invention. In this situation the communication channels 610, 611 become the same single communication channel. For the convenience of the users, an electronics camera can be set up approximate to an invented display stand. In this way, the facial image of the user is displayed immediately onto the monitor as long as the user stands in a predefined position, typically an area in front of the display apparatus.

From the foregoing, it should now be appreciated that the applicant has disclosed herein embodiments of an apparatus which function to display a personalized facial image of a real person and which functions to support articles of clothing. It is intended that apparatus in accordance with the invention be utilized by a user to easily coordinate, appraise or harmonize apparel before putting the clothing on. It is appreciated that the display region displaying the facial image may be represented by a computer monitor or a mirror. Particularly, it should be noted that the personalized image may be provided by simply transferring the facial image of a person to the display area, covering the display region with a mirror or providing an electronics means such as LCD monitors to represent the display region. It is contemplated that an apparatus in accordance with the invention be able to pick up and display electronics images fetched from a remote computer via a communication channel. It is disclosed that the personalized facial image of a real person can be combined with a selected garment displayed. Although detailed embodiments of the invention have been disclosed, it is recognized that variations and modifications, all within the spirit of the invention, will occur to those skilled in the art. It is accordingly intended that all such variations and modifications be encompassed by the appended claims.

What is claimed is:

1. A display apparatus configured for a user to appraise, coordinate or harmonize a garment comprising:

a first member structured to support said garment;

a second display member located appropriately next to said first member for displaying appropriately a first facial image represented by a first identifier or a second facial image represented by a second identifier, and means in response to an identifier submitted, enabling a selected facial image to be appraised together with said garment.

2. The display apparatus of claim 1 wherein said display member comprises an electronic display apparatus.

3. The display apparatus of claim 2 further comprising a third member to capture the facial image of said user for displaying onto said electronics display apparatus.

4. The display apparatus of claim 3 wherein said third member comprises of a camera.

5. The display apparatus of claim 3 wherein said third member comprises of a scanner.

6. The display apparatus of claim 3 wherein said third member provides electronics data representing the facial image of a person.

7. The display apparatus of claim 2 further comprising a memory device to store the facial image of a person.

8. The display apparatus of claim 7 wherein said memory device is portable.

9. The display apparatus of claim 2 further comprising a device to fetch the data resenting a human face from an external or remote source.

10. The display apparatus of claim 2 wherein said facial image is a personalized facial image.

11. The display apparatus of claim 2 wherein a user is identified by a code.

12. The display apparatus of claim 4 wherein said camera locates proximate to said electronics display apparatus.

13. The display apparatus of claim 2 further comprising a computing apparatus.

14. The display apparatus of claim 2 wherein multiple images are displayed on said electronics display apparatus.

15. The display apparatus of claim 14 wherein a motion picture is displayed on said electronics display apparatus.

16. The display apparatus of claim 1 wherein said first member is a structure representing at least part of a torso of a human body.

17. The apparatus of claim 2 further comprising a communication channel.

18. The apparatus of claim 2 wherein the image displayed on said electronics display apparatus had been edited by computer software.

19. An apparatus configured for a user to appraise, coordinate or harmonize a garment comprising:

a first member structure to support said garment;

first input means to capture the facial image of a user and assign said facial image an identifier;

second input means to receive the identifier of a user; and a second electronics display member located appropriately next to said first member for suitably displaying the facial image of said user according to an identifier received by said second input means.

20. A method for a users to appraise, coordinate or harmonize a garment comprising the steps of:

1. providing a supporting member structured to support said garment;
2. providing a display member located appropriately next to said supporting member for displaying appropriately a first facial image represented by a first code or a second facial image represented by a second code, and
3. providing means in response to a code selected, enabling a selected facial image to be appraised together with said garment.

21. The method of claim 20 further comprising a step to provide an input means structured for receiving the code selected in step 3.

* * * * *